US009381395B2

(12) United States Patent
Pinzon

(10) Patent No.: US 9,381,395 B2
(45) Date of Patent: Jul. 5, 2016

(54) STATIONARY ARTICULATED BICYCLE

(76) Inventor: Cassiano Pinzon, Passo Fundo (BR)

( * ) Notice: Subject to any disclaimer, the term of this patent is extended or adjusted under 35 U.S.C. 154(b) by 0 days.

(21) Appl. No.: 12/997,354

(22) PCT Filed: Jun. 10, 2009

(86) PCT No.: PCT/BR2009/000168

§ 371 (c)(1),
(2), (4) Date: Dec. 10, 2010

(87) PCT Pub. No.: WO2009/149528

PCT Pub. Date: Dec. 17, 2009

(65) Prior Publication Data

US 2011/0105282 A1 May 5, 2011

(30) Foreign Application Priority Data

Jun. 12, 2008 (BR) ..... 0802886

(51) Int. Cl.

| | |
|---|---|
| ***A63B 21/00*** | (2006.01) |
| ***A63B 22/06*** | (2006.01) |
| *A63B 21/045* | (2006.01) |
| *A63B 22/16* | (2006.01) |

(52) U.S. Cl.

CPC ..... *A63B 22/0605* (2013.01); *A63B 21/0455* (2013.01); *A63B 22/16* (2013.01); *A63B 2022/0641* (2013.01)

(58) Field of Classification Search

USPC ..... 482/51–53, 57–65; 436/61

See application file for complete search history.

(56) References Cited

U.S. PATENT DOCUMENTS 3,126,075 A * 3/1964 Cole
4,674,742 A * 6/1987 Baatz ..... A63B 69/16 482/59
4,925,183 A * 5/1990 Kim ..... A63B 22/16 434/61
4,938,475 A * 7/1990 Sargeant ..... A63B 21/0053 324/160
4,955,600 A * 9/1990 Hoffenberg ..... A63B 21/015 434/61
4,957,282 A * 9/1990 Wakefield ..... A63B 26/003 472/21
5,016,870 A * 5/1991 Bulloch ..... A63B 22/0605 482/62
5,035,418 A * 7/1991 Harabayashi ..... A63B 22/0023 482/57
5,209,662 A * 5/1993 Fujita ..... G09B 9/058 273/442
5,240,417 A * 8/1993 Smithson ..... A63B 21/00181 348/121
5,328,195 A * 7/1994 Sommer ..... B62M 1/12 280/233
5,356,356 A * 10/1994 Hildebrandt ..... A63B 21/157 482/57
5,364,271 A * 11/1994 Aknin ..... A63B 21/00181 273/148 B
5,429,379 A * 7/1995 Grigoriev ..... B62K 25/08 280/212
5,480,366 A * 1/1996 Harnden ..... A63B 69/16 482/57
5,501,648 A * 3/1996 Grigoriev ..... B62M 1/12 482/57
5,662,559 A * 9/1997 Vasquez ..... A63B 22/16 434/61

(Continued)

FOREIGN PATENT DOCUMENTS

GB 2434325 7/2007

*Primary Examiner* — Stephen Crow
(74) *Attorney, Agent, or Firm* — Lambert & Associates; Gary E. Lambert; David J. Connaughton, Jr.

(57) ABSTRACT

The present invention relates to a stationary articulated bicycle for physical exercise, especially for interiors (indoor), such as sports centers and fitness centers. In essence, it is aimed with the invention, the characterization of a new conception of stationary bike which has a hinge between two elements of a structure, to allow their relative angular displacement, which is intended to provide both a combination of balance and freedom, sensitive to forces applied to remove all and any impact that occurs in bone and nerve structure of the human body, providing comfort to the practitioner.

1 Claim, 5 Drawing Sheets

(56) References Cited

U.S. PATENT DOCUMENTS 6,126,577 A * 10/2000 Chang ..... A63B 26/003 434/61
6,234,800 B1 * 5/2001 Koyama ..... A63B 22/16 434/61
6,322,480 B1 * 11/2001 Lim ..... A63B 26/003 472/103
6,648,802 B2 * 11/2003 Ware ..... A63B 21/015 482/57
7,326,151 B2 * 2/2008 Peterson ..... A63B 22/16 482/57
7,927,258 B2 * 4/2011 Irving ..... A63B 21/015 482/51
8,092,352 B2 * 1/2012 Irving ..... A63B 23/0476 482/57
8,371,992 B2 * 2/2013 Irving ..... A63B 21/015 482/57
8,480,545 B2 * 7/2013 Irving ..... A63B 23/0476 482/57
8,894,550 B2 * 11/2014 Irving ..... A63B 21/015 482/57
2002/0077221 A1 * 6/2002 Dalebout ..... A63B 26/003 482/57
2002/0151415 A1 * 10/2002 Hildebrandt ..... A63B 21/157 482/57
2003/0171191 A1 * 9/2003 Crawford ..... B62K 21/12 482/57
2004/0023759 A1 * 2/2004 Duncan ..... A61N 1/36003 482/57
2005/0209064 A1 * 9/2005 Peterson ..... A63B 22/16 482/61
2007/0037679 A1 * 2/2007 Geeting ..... A63B 21/0004 482/130
2007/0049467 A1 * 3/2007 Lin ..... A63B 21/015 482/57
2007/0105694 A1 * 5/2007 Panatta ..... A63B 71/0036 482/57
2008/0020908 A1 * 1/2008 Ibarguren ..... A63B 22/0605 482/57
2008/0058170 A1 * 3/2008 Giannascoli ..... A63B 69/16 482/57
2008/0102424 A1 * 5/2008 Holljes ..... A63B 21/4047 434/247
2008/0103027 A1 * 5/2008 Nagel ..... A47D 9/02 482/57
2008/0269025 A1 * 10/2008 Badarneh ..... A63B 26/003 482/57
2009/0048076 A1 * 2/2009 Irving ..... A63B 21/015 482/57

* cited by examiner

STATIONARY ARTICULATED BICYCLE

CROSS REFERENCE TO RELATED APPLICATION

This application is for entry into the U.S. National Phase under §371 for International Application No. PCT/BR2009/000168 having an international filing date of Jun. 10, 2009, and from which priority is claimed under all applicable sections of Title of the United States Code including, but not limited to, Sections 120, 363 and 365(c), and which in turn claims priority under 35 USC 119 to Brazil Patent Application No. P10802886-9 filed on Jun. 12, 2008.

BACKGROUND OF THE INVENTION

1. Field of the Invention

The present invention relates to a stationary rotulated bicycle for physical exercise, especially for interiors (indoor), such as sports centers and fitness centers, this equipment is covered with very unique and peculiar technical features, when being compared with the principles of solution presented by the relevant devices in the state of the art in this report.

In essence, it is sought with the invention, the characterization of a new design of stationary bike which has a hollow tube, located between two elements of a structure, to allow their relative angular displacement, which is intended to provide a combination of balance and freedom offering excellent comfort. Further, the invention is to absorb much of the impact on the user.

2. Description of the Related Art

Currently, there are many bicycles being used for physical exercises in internal environment. The modality for which the object of the invention is directed is popularly known as "spinning", "indoor cycle," "RPM", etc., These types of exercise bicycles have a special form with a wheel of inertia called a steering wheel, which lets you adjust the load of pedaling according to the appropriate level of training, depending on the ability of the user. The practitioner looks for this modality to achieve increased calorie burning, and thus a quicker and more efficient result to obtain its physical fitness.

According to Augspurger, 1991, U.S. Pat. No. 5,050,865, the bicycle is one of the most beneficial forms of aerobic exercise, conditioning the individual to sustain an increase in heart rate without the impact of the physical set which is proportionate to other forms of exercise such as running. Cycling for exercise is popular as it is an activity that can be performed by people of all ages. However, there are limitations as to time, or other weather conditions that do not allow the cyclist riding a bicycle outside of indoor environments, on a road or street. In this situation, the author presents in his invention a stationary device adapted to support a conventional bicycle and the combination may be operated as a stationary exercise machine.

According to Harabayashi, 1991, U.S. Pat. No. 5,035,418, the conventional athletic facilities are constructed to form strength in the user's legs in a stationary position but not for both sides during pedaling.

However, when cycling, there is not just a straight track, but also upward and downward path. Thus, the author displays in the object of his invention, a type of athletic equipment that can tilt the seat of the user to any angle in any direction during pedaling, reinforcing the strength of the legs.

According to Chang, 2000, U.S. Pat. No. 6,126,577, there are a number of physical devices for allowing people to exercise in indoor environments. For example, the stationary bike, as one of the best machines to a program of cardiovacular conditioning. However, the conventional models are rigidly mounted in a fixed position, making it unable to simulate angular movements, causing a nuisance to the user in a short period of time. Based on these considerations, the author explains that the main objective of his invention is to provide an improved exercise of stationary bicycle which can be balanced from side to side.

Later Lim, 2001, U.S. Pat. No. 6,322,480, says a bike in an enclosed space became one of the most popular tools to exercise without spending much time, these bikes include a base in which the chassis is mounted, and this base is fixed to the chassis so that it can not move or rock during the action of pedaling. So when a person is prepared to go on a bike like that, he can not feel the activities covered by oscillating outdoor bicycles, getting easily tired of this type of bike in an enclosed space. Thus the author describes the improvement of a bicycle in enclosed space, which has unsteadiness, providing activities like the bike to swing open, the benefit is that you do not feel pain in the muscles.

Later Ziad, 2005, under publication in PCT No. WO 2005/046806, presents a new design for indoor exercise bicycles, which are unstable, having a system to control the instability, simulating a feeling of being pedaling on a mobile bicycle. Recently Peterson, 2008, U.S. Pat. No. 7,326,151, says that most of the training devices presented in the market, to be mounted on conventional bicycles, only provide movement of pedals and crank. This is a problem because the training can not simulate a hill climb, allowing the side balance that moves the bike as in real conditions of outdoor use. The inventor produced a device to be attached to a bicycle that simulates real conditions of use.

SUMMARY OF THE INVENTION

Considering the state of the technique previously described, in the use of the inventions listed, it can be attributed some drawbacks. Chang, 2000, U.S. Pat. No. 6,126,577, describes the use of hydraulic cylinders to generate angular movement causing the exercise bike to not move quickly back to its vertical position and it is unstable in use, thus making it unfit for practical use (column 1, lines 29 to 32). Thus, U.S. Pat. No. 5,050,865 and U.S. Pat. No. 5,035,418 are inadequate for the application, since they assume solution using this type of mechanism. Therefore, Chang himself says he has solved the instability problem adding springs in the system, same principle later used by Peterson. The fact is, both authors, do not remove the hydraulic cylinders, they just add springs, with the intention to stabilize the system and they make it insensitive, not favoring the comfort of the user.

Ziad probably took into consideration the question "instability", for he presented an assisted control for this through a pump or an electric motor, predicting the possibility of the cylinders being on gas. Together with the lateral system of articulation, he also arranged the simulation of curves via a movable handlebar. In critical analysis to the mentioned invention (WO 2005/046806), it is unwise to say the system does not work, but an expert in the technical issue may agree the invention presents complexity in its operation, making it difficult to adjust properly the system in general. Another concern is the issue of positioning the axis of rotation, which allows angular movement that is set above the ideal point for obtaining the proper functioning which would simulate a street bicycle.

For that reason, it is the intention of this invention to characterize a stationary hollow tube bike that will solve all issues presented, guaranteeing a product with excellent functional outcome, suitable for the practice of the exercise said previously. The focus of the invention is in the lattice degrees of freedom, allowing angular movement supported by a torsion bar, while offering a combination of balance and freedom, sensitive to forces applied to remove all and any impact that occurs in bone and nerve structure of the human body, providing comfort to the practitioner.

BRIEF DESCRIPTION OF THE DRAWINGS

In order to illustrate and clarify the invention, it is made reference to the illustrative attached drawings that constitute and support the present descriptive report, and where you see:

In drawing 1, a view in perspective of dimeter of the stationary rotula bicycle;

Figure 1:
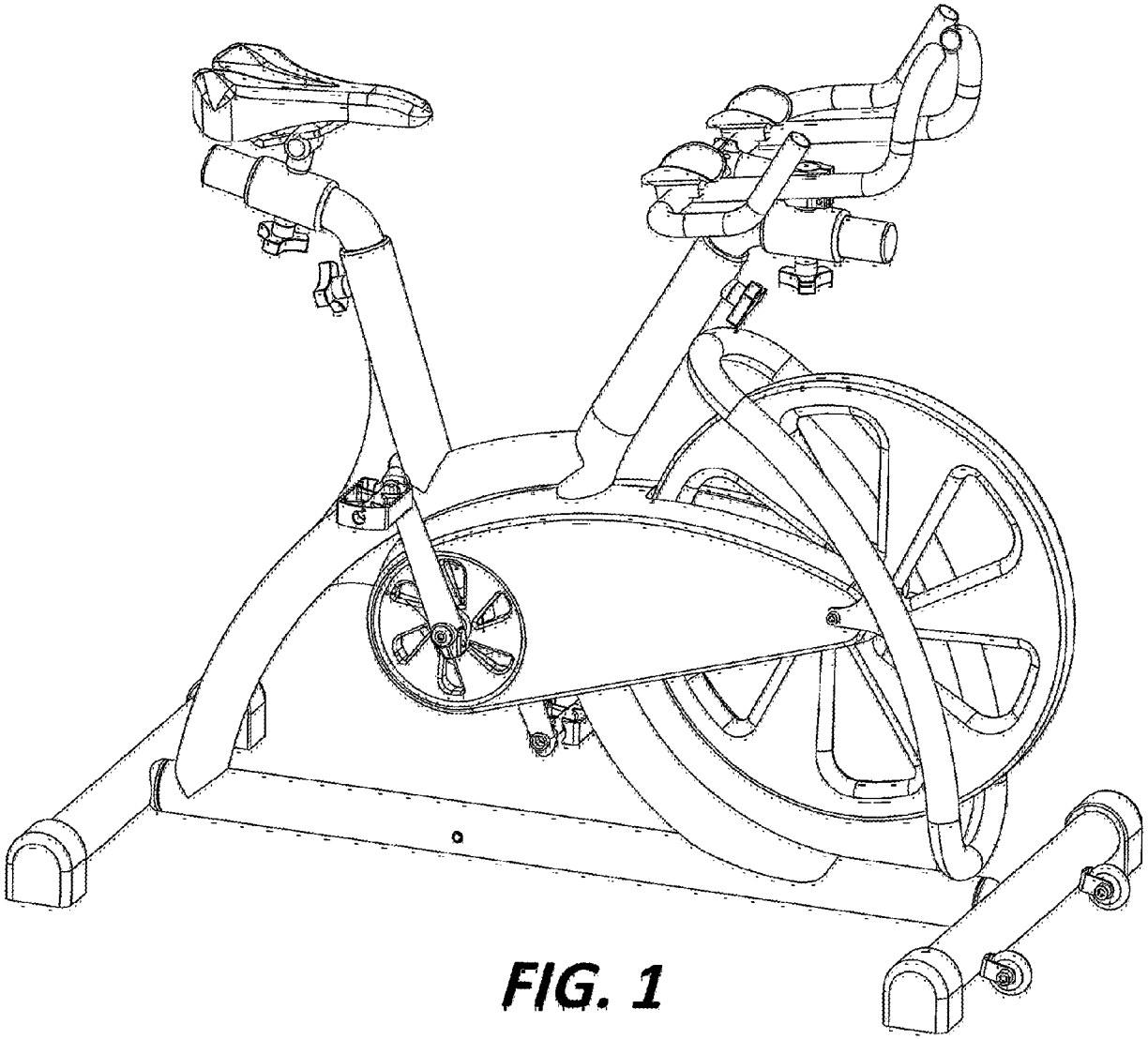
Figure 2:
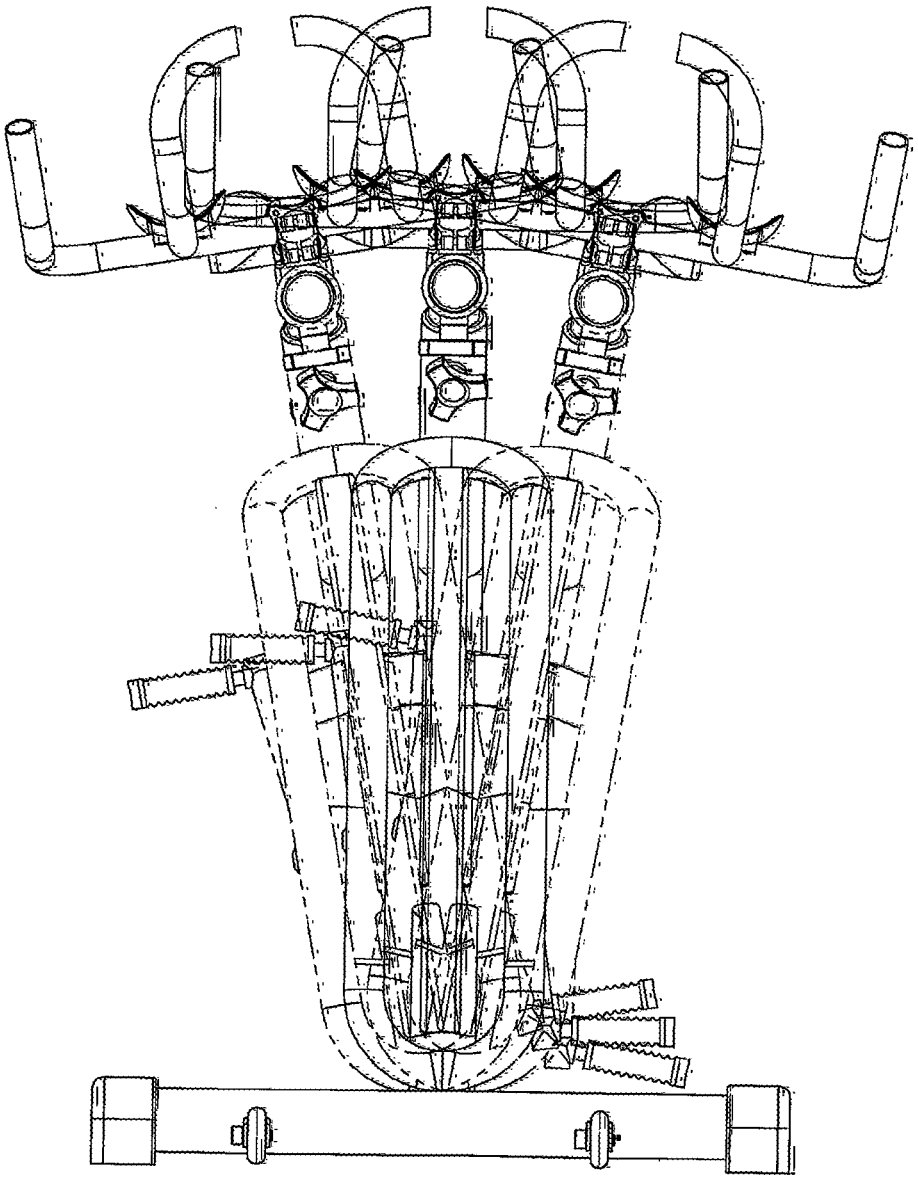
Figure 3:
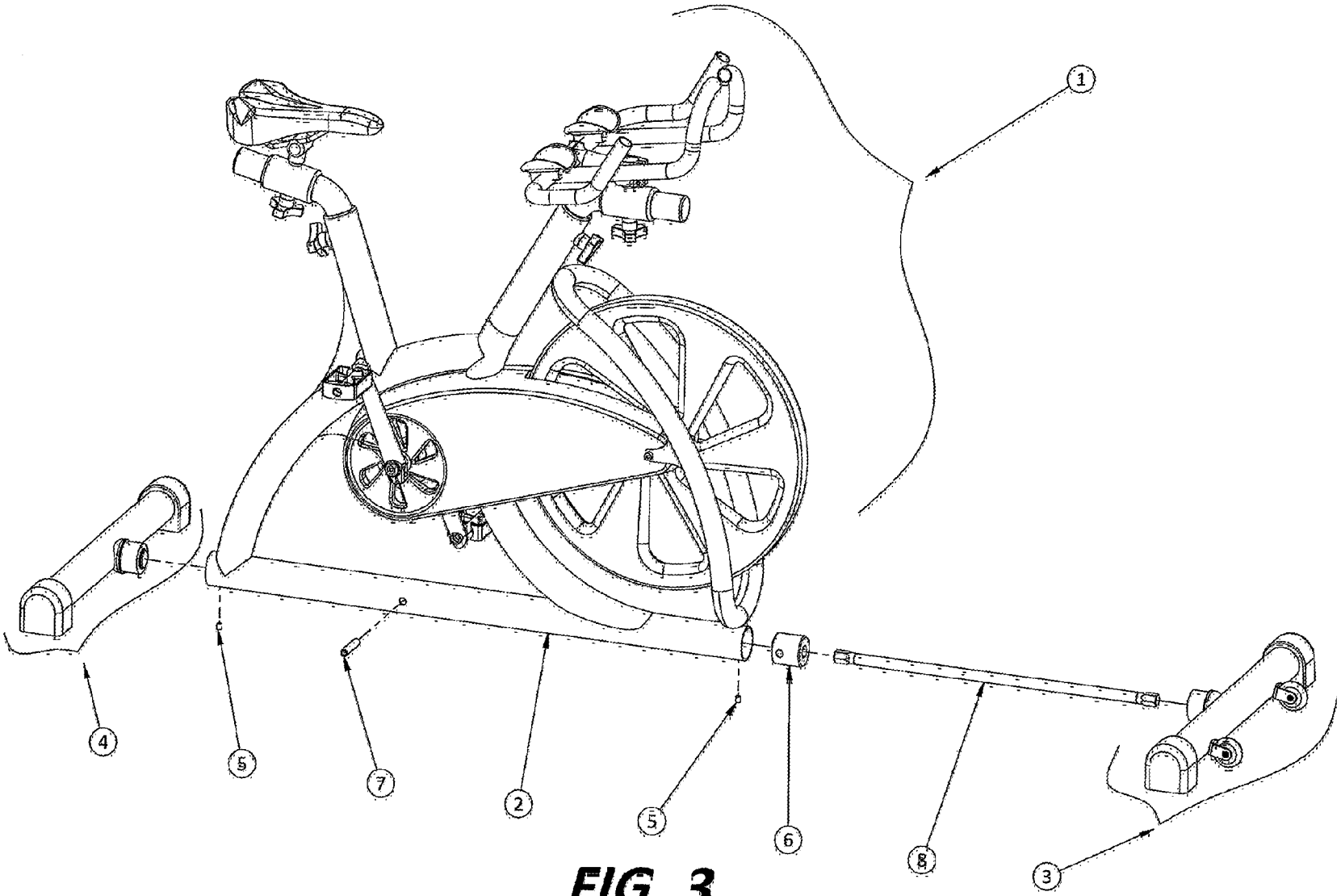
Figure 4:
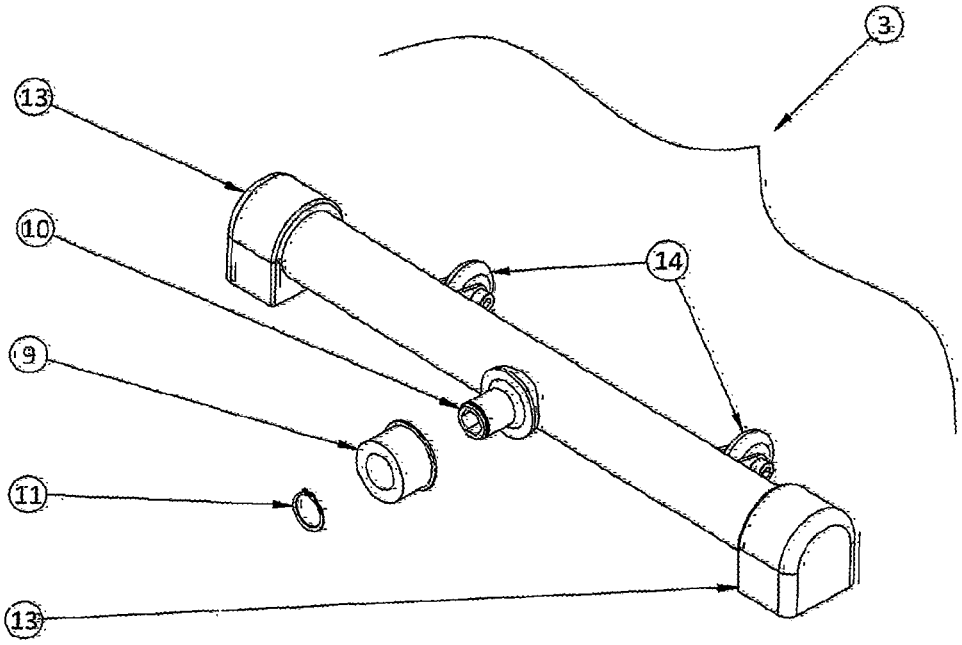
Figure 5:
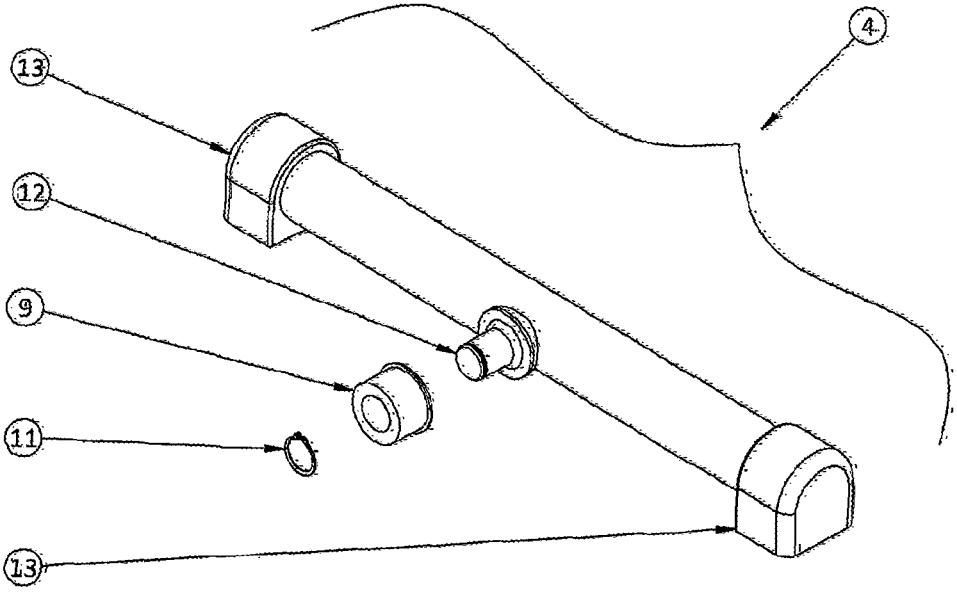
Figure 6:
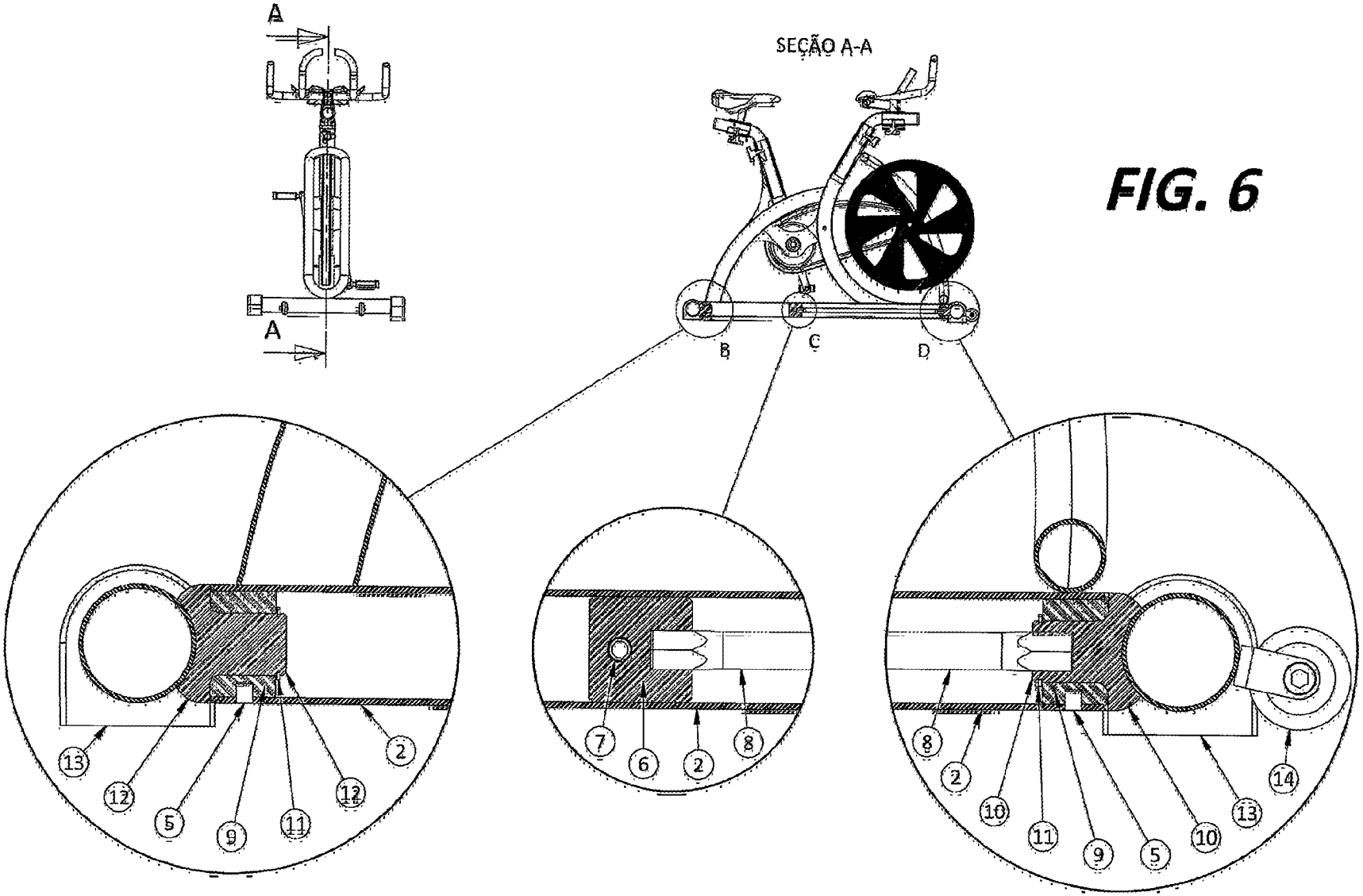

In drawing 2, a front view of FIG. 1, identifying the angular motion allowed by the torsion bar;

In drawing 3, an exploded view in dimeter perspective of FIG. 1, identifying the main elements;

In drawing 4, a view in exploded isometric perspective of the front base;

In drawing 5, a view in exploded isometric perspective of the rear base;

In drawing 6, a frontal and right side view in cut of the stationary hollow tube bike with detailed views of the assembly.

DETAILED DESCRIPTION OF THE INVENTION

As can be inferred by the analysis of the drawings related above, the stationary hollow tube bicycle consists of a bicycle (1) composed of a hollow tube (2) supported by two bases, front base (3) and rear base (4). Allowing angular movement limited by the torsion bar (8).

The torsion bar (8) is attached at both ends of one side in the kernel (6), which is fixed under the hollow tube (2) through the elastic pin (7), and the other on the axle (10), which is fixed on the front base (3).

Both front (3) and rear bases (4) are embedded in the hollow tube (2) through the bearing bushing (9), which is limited in its position by the elastic ring (11). These bases are differentiated by the format of the axles (10) and (12), and by the wheels (14), which are only designated for the front base (3), making it possible to shift the bike if necessary. It is also noted that the bases (3) and (4), are mounted on supporters (13) giving support through the ground for the whole system. Recalling also that both front and rear, the bases are aligned on the same axis in the axial direction.

With the functioning of the system the bases are likely to move up with the intention of jumping off the hollow tube (2) so the bearing bushing (9) was fixed to the hollow tube (2) through the screw (5).

The operation of the stationary hollow tube bike is very simple and can be described as follows: the front (3) and rear bases (4), supported on the floor, let the bike (1) develop angular movements through the bush of bearing (9). These movements are limited by the torsion bar (8), providing a balance point to the bike (1).

By pedaling the bicycle, the user exerts forces, once in each foot in turn. This force makes the bike turn on the bearings, and is absorbed by the torsion bar. The center of gravity of the whole bike and practicing is not changed, only distributed in an alternating way between them, that is, when riding without being seated on the seat, the user moves the hip to one side while the arms move the bike to another, compensating the mass change of the athlete and bike, with comfort and feeling of freedom of a conventional street bicycle in an inside environment.

The invention claimed is:

1. A stationary articulated bicycle assembly comprising:

a stand comprising a front base, a rear base, and a hollow tube joining the two, the tube being perpendicular to a major axis of the front base and the rear base;

a torsion bar positioned within the tube, connected at a first end to the front base, and connected to a kernel within the tube at a second end, the kernel being attached within the tube by an elastic pin joining the tube and the kernel;

a first bearing bushing joining the tube to the front base, allowing axial rotation of the tube relative to the front base;

a second bearing bushing joining the tube to the rear base, allowing axial rotation of the tube relative to the rear base;

at least two supporters on each of the front base and rear base, the at least two supporters elevating the front base and rear base off the ground;

a stationary bicycle mounted to only the tube, the stationary bicycle comprising:

a seat;

a pedal assembly below the seat, the pedal assembly comprising pedals;

a wheel, the wheel in mechanical communication with the pedal assembly; and handlebars, the handlebars positioned above the wheel; and wherein the stationary bicycle is rotatable relative to the front base and rear base, and limited in its rotation only by the torsion bar, such that when pedaling the pedal assembly of the bicycle, a user exerts forces on each foot in turn, this force angles the bicycle towards the force, as the force is absorbed by the torsion bar, a user moves a hip to one side while urging the bike to an opposite side using the user's arms.

* * * * *